US008565469B2

(12) United States Patent
Birdwell

(10) Patent No.: US 8,565,469 B2
(45) Date of Patent: Oct. 22, 2013

(54) APPARATUS PERTAINING TO A COVER-ATTACHMENT ASSEMBLY FOR USE WITH AN AUDIO-ANNUNCIATING HOUSING

(75) Inventor: Timothy Gale Birdwell, Lafayette, TN (US)

(73) Assignee: HeathCo, LLC, Bowling Green, KY (US)

( * ) Notice: Subject to any disclaimer, the term of this patent is extended or adjusted under 35 U.S.C. 154(b) by 267 days.

(21) Appl. No.: 12/620,210

(22) Filed: Nov. 17, 2009

(65) Prior Publication Data

US 2011/0116676 A1 May 19, 2011

(51) Int. Cl.
*H04R 1/02* (2006.01)

(52) U.S. Cl.
USPC ..... 381/386; 340/392.1; 340/392.4

(58) Field of Classification Search
USPC ..... 381/73.1, 61, 386, 400; 340/384.7, 340/396.1, 392.1; 705/7; 361/634; 16/355
See application file for complete search history.

(56) References Cited

U.S. PATENT DOCUMENTS

| | | | | |
|---|---|---|---|---|
| 4,181,924 | A * | 1/1980 | Thomas et al. | 361/634 |
| D287,704 | S | 1/1987 | Wheeler | |
| 4,971,758 | A | 11/1990 | Suzuki et al. | |
| D337,513 | S | 7/1993 | Soloway et al. | |
| 5,329,836 | A | 7/1994 | Stannard | |
| 5,519,572 | A * | 5/1996 | Luo | 361/679.23 |
| 5,537,716 | A * | 7/1996 | Komamura | 16/355 |
| D382,502 | S | 8/1997 | Ryan | |
| 5,764,131 | A | 6/1998 | Twining et al. | |
| 5,774,041 | A * | 6/1998 | Xydis et al. | 340/396.1 |
| D410,404 | S | 6/1999 | Scheibe | |
| 5,909,169 | A | 6/1999 | Lin | |
| D439,186 | S | 3/2001 | Kovens et al. | |
| 6,750,760 | B2 * | 6/2004 | Albritton et al. | 340/392.1 |
| D512,422 | S | 12/2005 | Sato et al. | |
| 7,126,490 | B2 | 10/2006 | Cole, Sr. et al. | |
| D567,692 | S | 4/2008 | Meyers et al. | |
| D569,343 | S | 5/2008 | Hung et al. | |
| D611,863 | S | 3/2010 | Kato | |
| D643,457 | S | 8/2011 | DeLong | |
| 7,990,281 | B2 | 8/2011 | Tylicki et al. | |
| D656,763 | S | 4/2012 | Fejt | |
| D676,346 | S | 2/2013 | Birdwell | |

(Continued)

OTHER PUBLICATIONS

Furnace Blower Door Safety Switch as shown on http://www.ecrater.com/product.php?pid=2239870 printed on May 12, 2009, 1 page.

(Continued)

*Primary Examiner* — Duc Nguyen
*Assistant Examiner* — Phan Le
(74) *Attorney, Agent, or Firm* — Fitch Even Tabin & Flannery LLP

(57) ABSTRACT

A cover-attachment assembly works in conjunction with an audio-annunciator housing that is configured to operationally mount to a wall. This audio-annunciator housing can have one or more arcuately-shaped tracks and one or more snap interfaces. The cover-attachment assembly comprises at least one arcuately-shaped guide surface that is shaped, sized, and positioned to fit within the arcuately-shaped track when pivotally attaching the cover-attachment assembly to the audio-annunciator housing. The snap interface, in turn, is shaped, sized, and positioned to lockingly mate with the audio-annunciator housing snap interface to hold the cover-attachment assembly in an installed position with respect to the audio-annunciator housing.

30 Claims, 8 Drawing Sheets

(56) References Cited

U.S. PATENT DOCUMENTS

| | | | | |
|---|---|---|---|---|
| 2002/0126851 | A1* | 9/2002 | Lo et al. | 381/61 |
| 2003/0090369 | A1 | 5/2003 | Albritton et al. | |
| 2005/0147271 | A1* | 7/2005 | Shain | 381/386 |
| 2006/0290477 | A1* | 12/2006 | Cole et al. | 340/384.7 |
| 2007/0003099 | A1* | 1/2007 | Madni et al. | 381/400 |
| 2007/0279198 | A1 | 12/2007 | Chen et al. | |
| 2008/0112571 | A1* | 5/2008 | Bradicich et al. | 381/73.1 |
| 2008/0221956 | A1* | 9/2008 | Bloch et al. | 705/7 |

OTHER PUBLICATIONS

Design U.S. Appl. No. 29/357,234, filed Mar. 9, 2010.

* cited by examiner

APPARATUS PERTAINING TO A COVER-ATTACHMENT ASSEMBLY FOR USE WITH AN AUDIO-ANNUNCIATING HOUSING

RELATED APPLICATION(S)

This application is related to co-owned U.S. patent application Ser. No. 12/347,044, entitled Apparatus and Method Pertaining to a Doorbell Chime Cover and filed Dec. 31, 2008, issued on Aug. 2, 2011 as U.S. Pat. No. 7,990,281 B2 and, which is incorporated by reference in its entirety herein.

TECHNICAL FIELD

This invention relates generally to audio annunciators such as door bells and door chimes.

BACKGROUND

Audio annunciators of various kinds are known in the art. Examples include door bells and door chimes (wherein door bells typically refer to an annunciator that produces a sound by mechanical means and wherein door chimes typically refer to an annunciator that produces a sound by electrical means), alarms (such as fire alarms, smoke alarms, or intrusion alarms), and so forth.

In many cases these audio annunciators comprise a housing that is configured to be operationally mounted to a wall. This housing typically contains the sound-producing mechanism of choice and may also house other components such as a power supply, a user interface (to facilitate, for example, selecting from amongst a plurality of available annunciation sounds), and so forth.

For a variety of reasons such a housing often works in conjunction with a removable cover. In some cases the removable cover eases the task of installing the housing on the wall. In other cases the removable cover makes it possible for the user to access a user interface from time to time. In yet other cases the removable cover paradigm makes it possible for the user to select from amongst a plurality of available cover options to best suit their corresponding aesthetic needs.

Annunciator designers are therefore faced with a variety of utilitarian and aesthetic design requirements in these regards, many of which tend to be contrary to one another. The market for such products tends to be highly competitive and therefore such designs are highly cost sensitive. The cover should also tend to remain in place during use; many simple cover designs are readily subject to dislodging during simple and non-aggressive housecleaning activities. Other cover designs involve considerable effort, time, and/or tools to facilitate the removal and installation process. Such obstacles can greatly frustrate the end user and can discourage the user from such an activity. This, in turn, can deny the user from receiving the benefits associated with a removable cover.

BRIEF DESCRIPTION OF THE DRAWINGS

The above needs are at least partially met through provision of the apparatus pertaining to a cover-attachment assembly for use with an audio-annunciator housing described in the following detailed description, particularly when studied in conjunction with the drawings, wherein.

Figure 1:
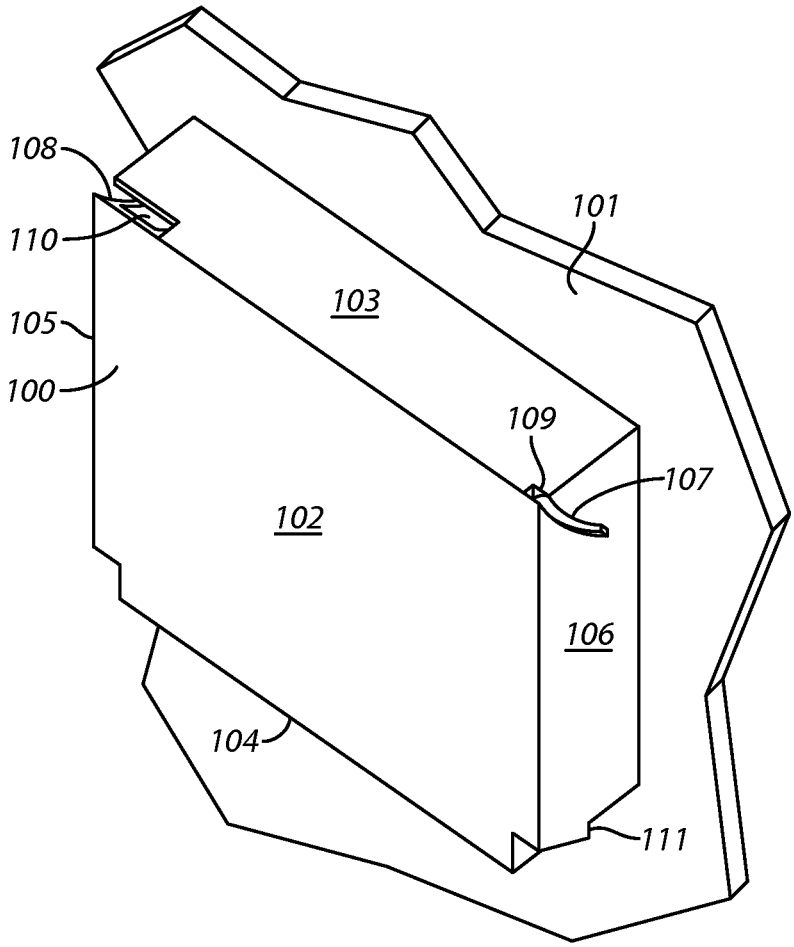
FIG. 1 comprises a perspective view as configured in accordance with various embodiments of the invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a cover-attachment assembly works in conjunction with an audio-annunciator housing that is configured to operationally mount to a wall. This audio-annunciator housing can have one or more arcuately-shaped tracks and one or more snap interfaces. The cover-attachment assembly comprises at least one arcuately-shaped guide surface that is shaped, sized, and positioned to fit within the arcuately-shaped track when pivotally attaching the cover-attachment assembly to the audio-annunciator housing. The snap interface, in turn, is shaped, sized, and positioned to lockingly mate with the audio-annunciator housing snap interface to hold the cover-attachment assembly in an installed position with respect to the audio-annunciator housing.

By one approach, the audio-annunciator housing has two of the aforementioned arcuately-shaped tracks that are located on, and at least partially open on, opposing sides of the housing. By one approach these arcuately-shaped tracks have their entrance opening disposed at an edge where a top side of the housing meets a front side thereof.

By one approach the audio-annunciator housing snap interface comprises an exterior feature of the housing and may further comprise an inflexible component. The cover-attachment assembly's snap interface, on the other hand, can comprise a flexible, resilient component. So configured, these snap interfaces will readily facilitate hand moving the cover-attachment assembly from an installed position to a non-installed position with respect to the audio-annunciator housing.

These teachings will readily accommodate integrally combining the cover-attachment assembly with a corresponding cover. These teachings will also accommodate, as desired, non-integrally combining these components.

These teachings will also accommodate providing the cover-attachment assembly with a cover-attachment sensor actuator that is configured to be sensed by a corresponding cover-attachment sensor when the cover-attachment assembly is in the installed position. This, in turn, can serve to aid in ensuring the proper installation of the cover-attachment assembly with respect to the housing.

So configured, those skilled in the art will appreciate that these teachings present a highly cost-effective mechanism for temporarily yet reliably securing a cover to an audio-annunciator housing. These teachings are also highly flexible and scalable and will accommodate a wide variety of functional and aesthetic requirements. Use of components that correspond with these teachings tends to be highly intuitive and can be readily and reliably implemented and used by a variety of end users including relatively unskilled persons in these regards.

These and other benefits may become clearer upon making a thorough review and study of the following detailed description. Referring now to the drawings, and in particular to FIG. 1, an audio-annunciator housing 100 can comprise a box-like housing comprised of any suitable material (such as plastic and/or metal). This housing 100 serves to contain some or all of the components (not shown) of the audio annunciator itself. This can include, but is not limited to, a mechanical or electronic audio transducer of choice along with a corresponding mechanical or electronic driver, respectively. Such components may also include part or all of a power supply, a user interface (such as one or more switches, buttons, screw terminals, patch cables, displays, and so forth), and the like. Those skilled in the art will recognize and understand that the specifics of this example serve an illustrative purpose only and are not offered with any suggestion or intent that these specifics comprise an exhaustive listing of all such possibilities in this regard.

Figure 2:
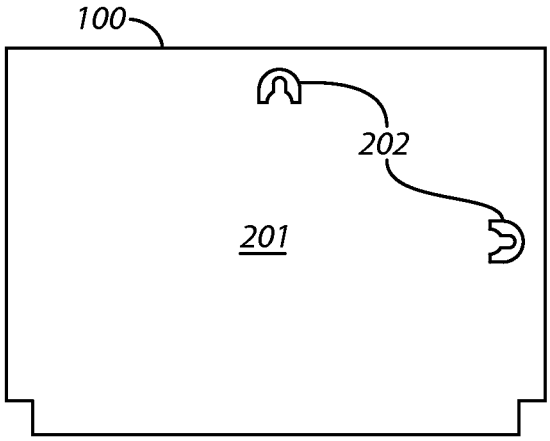
FIG. 2 comprises a rear-elevational view as configured in accordance with various embodiments of the invention.

This audio-annunciation housing 100 is configured to be operationally mounted to a wall 101. (As used herein, a "wall" will be understood to refer to a vertically-disposed surface. Examples include, but are not limited to, a wall in a residential or business setting (such as a hallway wall, a foyer wall, and so forth).) Those skilled in the art will recognize that there are a variety of known ways to effect such functionality. By one approach, and referring momentarily to FIG. 2, the backside 201 of the housing 100 can have one or more traps 202 disposed thereon to be placed over and to partially captivate, for example, the driver end of a screw, bolt, nail, or the like. Various approaches are known in the art in this regard. As these teachings are not overly sensitive to any particular selection in this regard, for the sake of brevity and the preservation of clarity, further elaboration in this regard will not be presented here.

In a typical application setting this housing 100 may have one or more doors or other mechanisms to permit access to the interior of the housing 100. As such accoutrements are not especially important here, for the sake of clarity and brevity such features are not shown here.

Referring again to FIG. 1, this housing 100 further comprises a front side 102, a top and bottom side 103 and 104, and two edge sides 105 and 106. These sides will be referred to further herein as appropriate.

Figure 3:
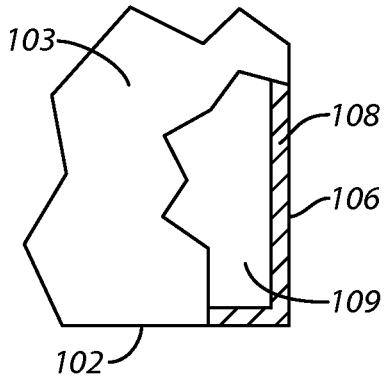
FIG. 3 comprises a top-plan detail view as configured in accordance with various embodiments of the invention.

This audio-annunciator housing 100 further comprises, in this illustrative example, two arcuately-shaped tracks 107 and 108. Referring momentarily to both FIGS. 1 and 3, a first one of these arcuately-shaped tracks 107 is formed at a corner where the front side 102, the top side 103, and the right-edge side 106 meet, with the entrance opening 109 being disposed at the edge where the top side 103 meets the front side 102. In this particular illustrative example this arcuately-shaped track 107 is also open on and through the aforementioned right-edge side 106 of the housing 100. Those skilled in the art will recognize that other possibilities are available with respect to such features as desired. The arcuately-shaped track 107 itself, in this example, is without any substantial non-arcuate discontinuity.

The second arcuately-shaped track 108 is somewhat similarly formed and situated opposite the first arcuately-shaped track 107 such that its entrance opening 110 is also disposed at the same edge where the top side 103 meets the front side 102. Here, however, this second arcuately-shaped track 108 is open on and through the aforementioned left-edge side 105 of the housing 100. In this example, these two arcuately-shaped tracks 107 and 108 are essentially vertically parallel to one another and share the same radius of curvature. These teachings will accommodate small discrepancies in these regards, and the lengths of these two tracks 107 and 108 may also differ from one another if desired in order to suit some particular need or opportunity as tends to characterize a particular application setting.

Figure 4:
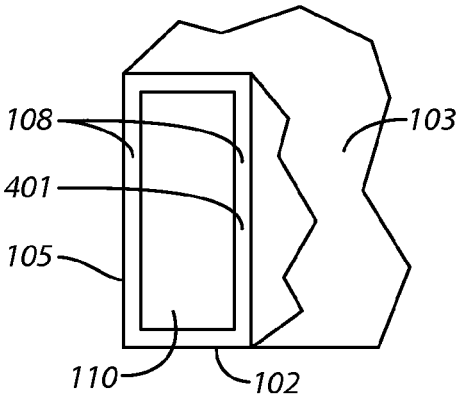
FIG. 4 comprises a top-plan detail view as configured in accordance with various embodiments of the invention.

In the examples just provided the tracks 107 and 108 are open at their sides through the corresponding proximal edge side 106 and 105, respectively. So configured, the thickness of the edge side itself comprises, in whole or in part, the arcuately-shaped track itself. As shown in FIG. 4, this can be supplemented by additional track material 401 formed further to the interior of the housing 100. By using the material of the edge sides themselves as at least a part of the arcuately-shaped tracks, however, manufacturing complexity can be reduced. These open tracks can also serve to increase the ease by which the cover can eventually be installed as described below.

Figure 5:
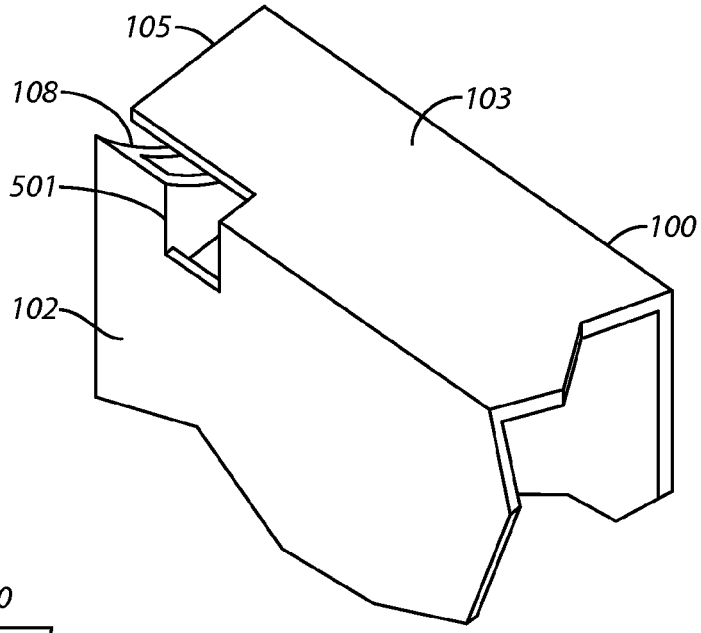
FIG. 5 comprises a perspective detail view as configured in accordance with various embodiments of the invention.
Figure 6:
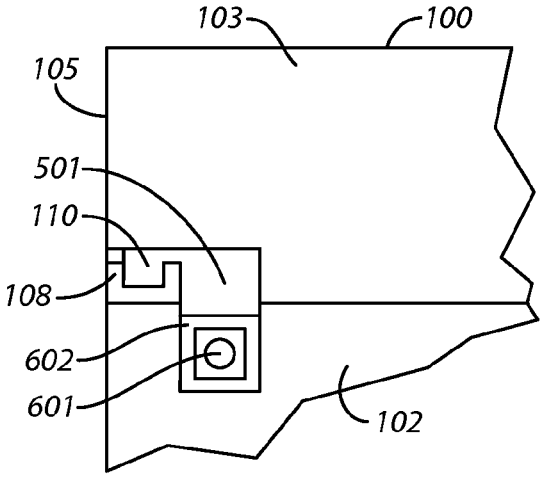
FIG. 6 comprises an angled front-elevational detail view as configured in accordance with various embodiments of the invention.

As alluded to earlier, these teachings will accommodate using a sensor to detect proper installation of a cover. To exemplify this concept by way of a non-limiting example, and referring now to FIGS. 5 and 6, the housing 100 can further comprise a notch 501 that is, in this illustrative example, contiguous with the opening 110 to one of the aforementioned arcuately-shaped tracks 108. This notch 501 through the housing provides physical access to a cover-attachment sensor 601 that is, in this example, mounted on a circuit board 602 that is itself installed within the interior of the housing 100. Various sensors will work and can vary with the needs and/or opportunities as tend to characterize a given application setting. Examples for this sensor 601 include, but are not limited to, electrical switches that are responsive to physical contact with an actuating member, optically-based sensors, capacitively-based sensors, and magnetically-based sensors. Those skilled in the art will recognize and understand that these examples are intended to serve only in an illustrative capacity and are not intended to comprise an exhaustive listing of all possibilities in this regard.

Figure 7:
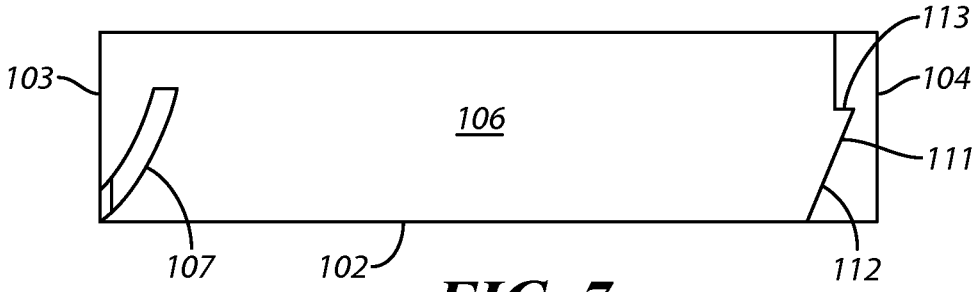
FIG. 7 comprises a side-elevational view as configured in accordance with various embodiments of the invention.

Referring now to both FIGS. 1 and 7, the housing 100 can further comprise one or more snap interfaces 111. In this illustrative example, both edge sides 105 and 106 have a snap interface 111 as an exterior feature of the housing 100 itself that is located towards the bottom side 104 of the housing 100. In this illustrative example, the housing snap interface 111 comprises an inflexible component and includes a first inclined surface 112 and a corresponding stop 113. Further discussion regarding these snap interfaces 111 appears below in conjunction with an explanation of the interaction between these snap interfaces 111 and their counterparts on a cover-attachment assembly.

Those skilled in the art will recognize and appreciate that these various described features of the audio-annunciator housing 100 do not unduly compromise the general form factor and footprint of the housing 100 itself. It will further be noted that these features can all comprise an integral part of such a housing. For example, when using injection molding techniques to form the housing 100, these features can all be readily formed by and during such a process. It will further be noted that none of these features, in this illustrative example, makes use of removable components. This, in turn, contributes to reliability, durability, cost effectiveness, and ease of manufacture.

Figure 8:
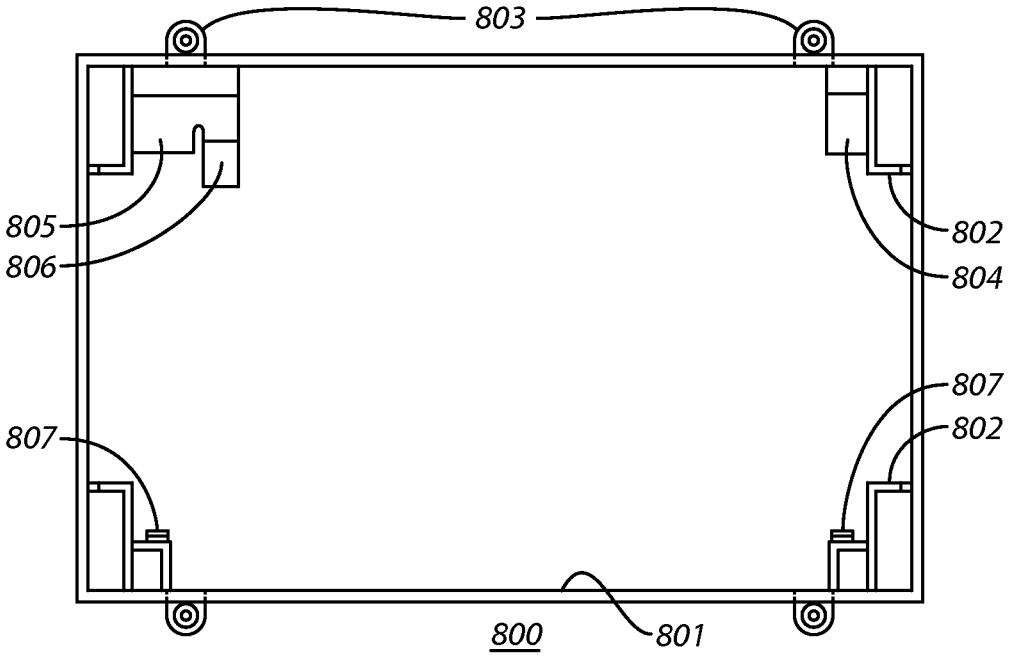
FIG. 8 comprises a front-elevational view as configured in accordance with various embodiments of the invention.
Figure 9:
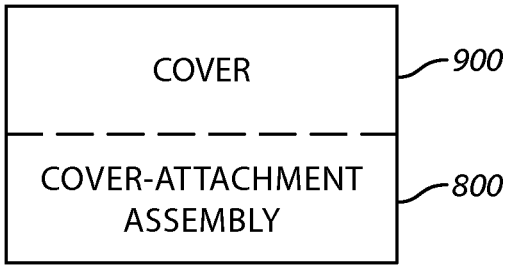
FIG. 9 comprises a block diagram view as configured in accordance with various embodiments of the invention.
Figure 10:
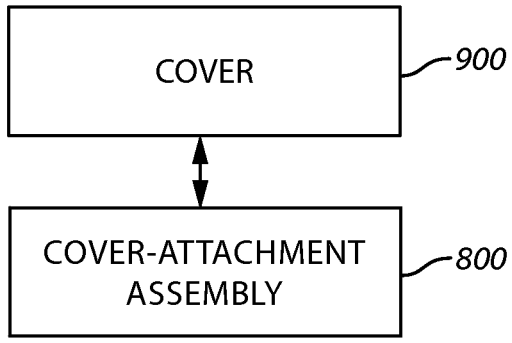
FIG. 10 comprises a block diagram view as configured in accordance with various embodiments of the invention.

Referring now to FIG. 8, a corresponding cover-attachment assembly 800 will be described. This cover-attachment assembly 800 generally serves to facilitate attaching a cover to the aforementioned audio-annunciator housing 100. With this in mind, and referring momentarily to FIG. 9, this cover-attachment assembly 800 can comprise an integral part of such a cover 900 if desired. (As used herein, this reference to "integral" shall be understood to be a combination of elements that is intended to be permanent during the useful lifetime of the resultant item. By one approach, this occurs when the two elements are formed as common parts of a single item (such as an injection-molded part). By another approach, and as another illustrative example in these regards, this occurs when the two elements are joined using an attachment mechanism such as a non-temporary adhesive, screws, or the like.). It should also be understood, however, that the cover-attachment assembly 800 can comprise a discrete component with respect to the cover 900 as illustrated in FIG. 10 and can be coupled to one another during use on a more temporary basis and where separation of the two elements is anticipated and expected during the ordinary operational lifetime of the resultant item.

Figure 11:
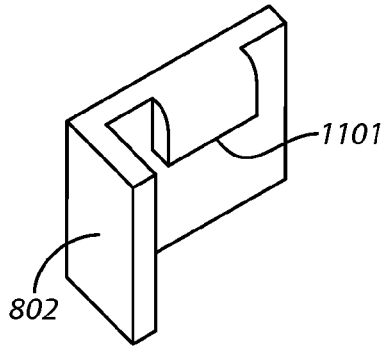
FIG. 11 comprises a perspective detail view as configured in accordance with various embodiments of the invention.

Referring again to FIG. 8, the cover-attachment assembly 800 comprises, in this illustrative example, a frame 801 that forms a hollow rectangle. Such a frame 801 can be formed using any of a wide variety of technologies. For the purposes of this illustrative example it will be presumed that the frame 801 comprises an injection-molded part formed of plastic. For strength this frame 801 has a brace member 802 disposed in each of its corners. If desired, and referring momentarily to FIG. 11, one or more of these brace members 802 can further comprise a stop 1101. This stop 1101, in turn, can cooperate with a catch mechanism on a cover to permit the latter to be temporarily and non-integrally connected to the cover-attachment assembly 800. As but one of many optional alternatives to such an approach, and referring again to FIG. 8, tabs 803 can be provided on the frame 801 to accommodate the use of a corresponding screw, bolt, or the like (not shown) to integrally couple the cover-attachment assembly 800 to a cover.

Figure 12:
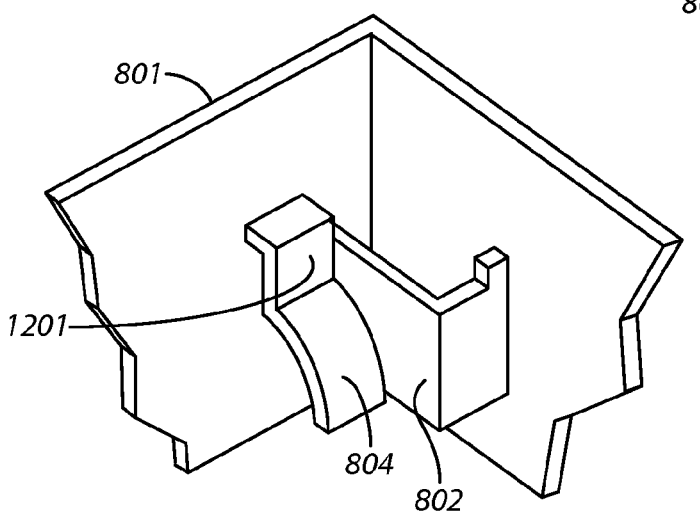
FIG. 12 comprises a perspective detail view as configured in accordance with various embodiments of the invention.

The cover-attachment assembly 800 also comprises one or more arcuately-shaped guide surfaces. These arcuately-shaped guide surfaces, in turn, are shaped, sized, and positioned to fit within the aforementioned arcuately-shaped tracks when pivotally attaching the cover-attachment assembly 800 to the audio-annunciator housing 100 as described below. Referring to both FIGS. 8 and 12, a first one of these arcuately-shaped guide surfaces is denoted by reference numeral 804. In this illustrative example, the arcuately-shaped guide surface 804 attaches via an intervening member 1201 to the frame 801 and also to one of the aforementioned brace members 802.

Figure 13:
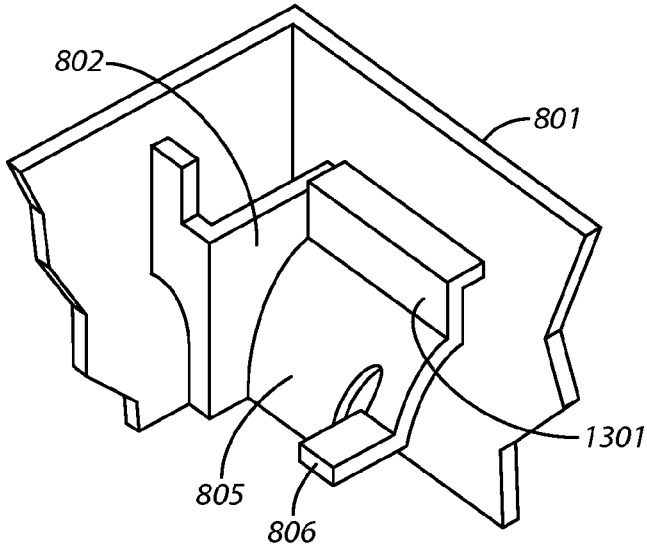
FIG. 13 comprises a perspective detail view as configured in accordance with various embodiments of the invention.

Referring now to both FIGS. 8 and 13, a second arcuately-shaped guide surface 805 is similarly situated in an opposing corner of the frame 801 and again connects to the frame 801 via an intervening member 1301 and to a corresponding brace member 802. In this example, the two arcuately-shaped guide surfaces 804 and 805 are presumed to be essentially parallel to one another with respect to their arcuate surfaces. These teachings will readily accommodate other variations, however. As but one example in these regards, the second arcuately-shaped guide surface 805 is wider than the first arcuately-shaped guide surface 804.

In this illustrative example, intended for use with a housing 100 having a notch 501 such as that described above with respect to FIG. 5, the cover-attachment assembly 800 also includes a cover-attachment sensor actuator 806 as shown in FIGS. 8 and 13. In this example, the aforementioned cover-attachment sensor 601 comprises an electrical switch and therefore this cover-attachment sensor actuator 806 comprises a tab that will contact that switch when the cover-attachment assembly 800 is installed on the audio-annunciator housing 100 as described herein.

Figure 14:
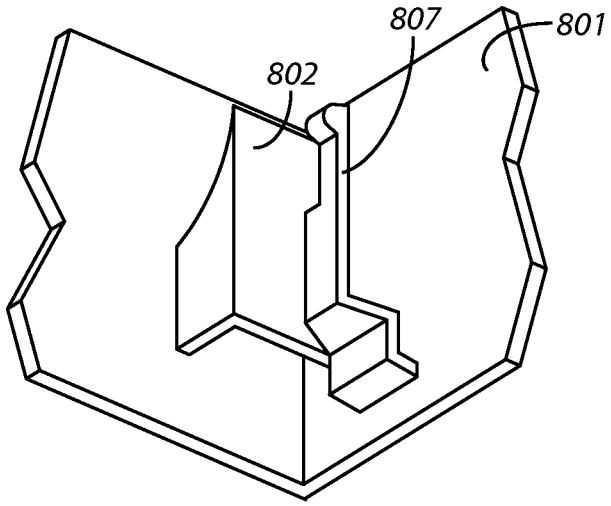
FIG. 14 comprises a top plan detail view as configured in accordance with various embodiments of the invention.

Referring now to both FIGS. 8 and 14, the cover-attachment assembly 800 also comprises, in this illustrative example, two snap interfaces 807 that are disposed in the remaining corners of the frame 801. These snap interfaces 807 are shaped, sized, and positioned to lockingly mate with the aforementioned audio-annunciator housing snap interfaces 111 when the cover-attachment assembly 800 is installed with respect to the audio-annunciator housing 100. As noted earlier, in this illustrative example, the audio-annunciator housing snap interfaces 111 are inflexible components. In this case, the cover-attachment assembly snap interfaces 807 comprise flexible, resilient components to facilitate a desired reversible mating interaction between these snap interfaces. Further details in this regard appear below where appropriate.

So configured, the cover-attachment assembly 800 can be readily, easily, and quickly installed on an audio-annunciator housing 100 that is itself mounted to a wall. In particular, and referring now to FIG. 15, the cover-attachment assembly 800 can be placed at approximately a 90 degree angle to the audio-annunciator housing 100 and the arcuately-shaped guide surfaces 804 and 805 positioned proximal to the corresponding arcuately-shaped tracks 107 and 108, respectively, as comprise a part of the audio-annunciator housing 100. The former can then easily slide into and along the latter as the cover-attachment assembly 800 is gently pivoted downwardly as suggested by the arrow denoted by reference numeral 1501.

It may be noted that, in this illustrative example, this engagement mechanism provides for some captivation of the arcuately-shaped guide surfaces in that they prevent the upper portion of the cover-attachment assembly 800 from falling further forward but that there is no catch mechanism to specifically retain these guide surfaces within their corresponding tracks. So configured, these guide surfaces can be easily removed from the tracks by simply reversing their direction of movement. It may also be noted in this illustrative embodiment that this comprises a relatively loose fit such that the cover-attachment assembly 800 will not hold itself in a partially-installed position where the latter is cantilevered outwardly of the housing 100. Instead, if the user were to release the cover-attachment assembly 800 at such a point, the cover-attachment assembly 800 would continue to pivot downwardly on its own.

Figure 16:
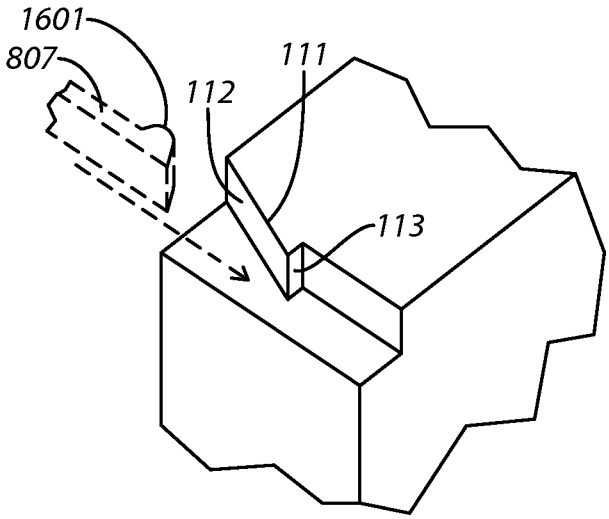
FIG. 16 comprises a perspective detail view as configured in accordance with various embodiments of the invention.
Figure 17:
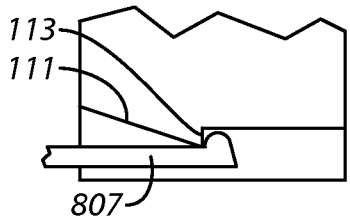
FIG. 17 comprises a side-elevational detail view as configured in accordance with various embodiments of the invention.

As the cover-attachment assembly 800 pivots downwardly and approaches its final installed position, and referring now to FIGS. 16 and 17, the cover-attachment assembly snap interface 807 moves into a snap-fitting mating engagement with the audio-annunciator housing snap interface 111. In particular, the former 807 flexes as its end 1601 contacts and cams along the inclined surface 112 of the latter. At the conclusion of the inclined surface 112, the former 807 then resiliently moves inwardly towards the housing 100 to provide the desired snap fit.

Figure 18:
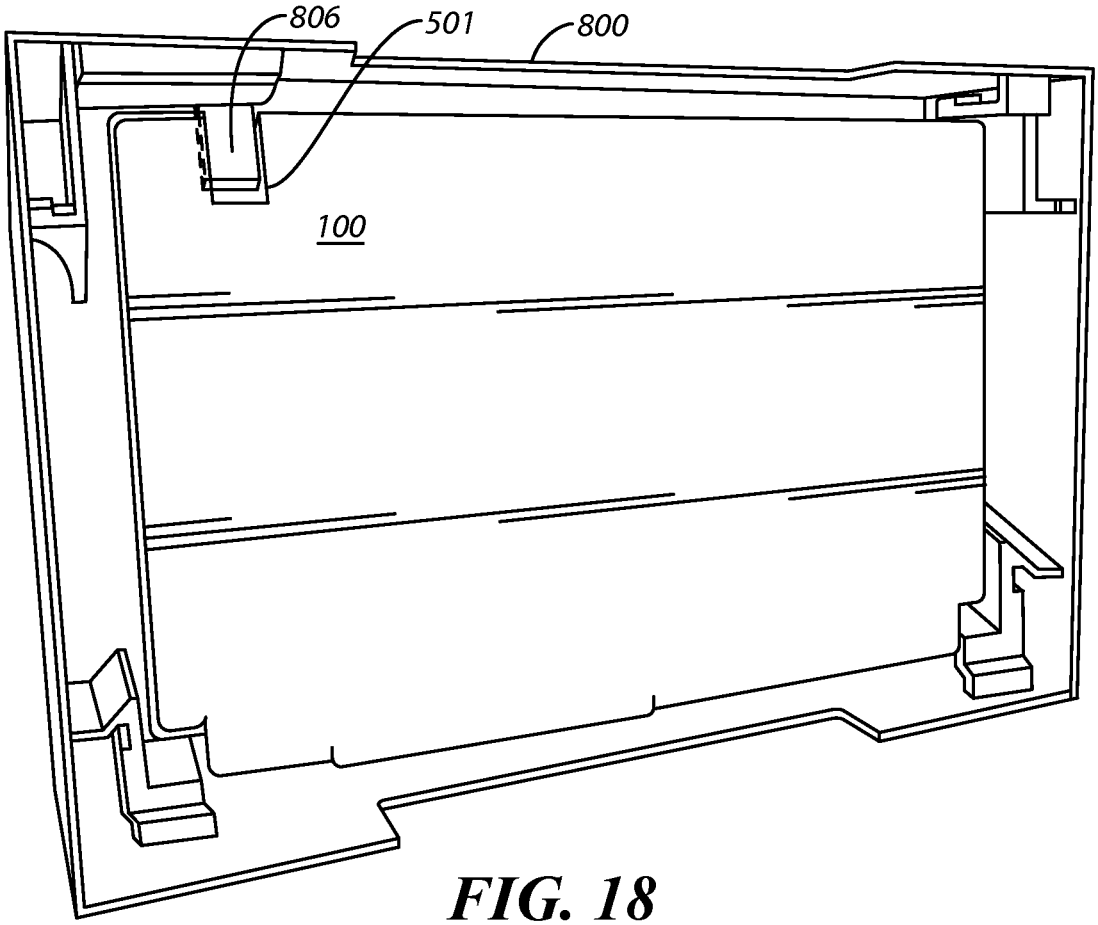
FIG. 18 comprises a perspective view as configured in accordance with various embodiments of the invention.

This fit can be sufficient to hold the cover-attachment assembly 800 in an installed position as shown in FIG. 18. Those skilled in the art will further recognize and appreciate that the cover-attachment assembly 800 can be readily and easily uninstalled by simply grasping the lower portion of the cover-attachment assembly 800 and moving its bottom portion outwardly to disengage the snap interfaces from one another. Once disengaged, the cover-attachment assembly 800 can be pivoted upwardly to essentially reverse the described installation procedure. This will permit the user to have easy access to the audio-annunciator housing 100 to change batteries, reprogram the device, or conduct other maintenance. This will also permit the user to easily exchange one cover for another to suit whatever current aesthetic needs the user may have.

Figure 15:
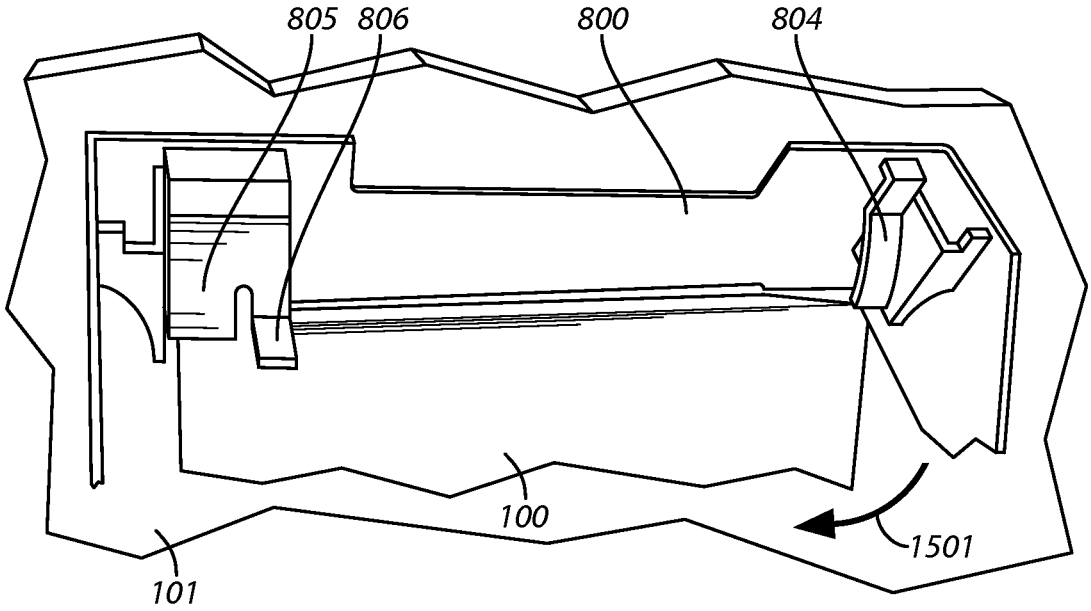
FIG. 15 comprises a perspective detail view as configured in accordance with various embodiments of the invention.

A comparison of FIG. 15 with FIG. 18 also illustrates that the cover-attachment sensor actuator 806 also pivots from a beginning position to an installed position within the notch 501 provided in the audio-annunciator housing 100. This, in turn, serves to move the cover-attachment sensor actuator 806 into contact with the previously-described sensor switch 601 to thereby indicate to the audio annunciator that the cover-attachment assembly 800 is, in fact, properly installed. In the absence of such an indication, if desired, the operation of the audio annunciator can be modified to prevent the apparatus, for example, from operating in a normal state when a cover may be inappropriately installed and hence at risk of falling or the like.

Those skilled in the art will recognize and appreciate that these teachings provide an easily understood, essentially intuitive mechanism for installing and removing a cover from a wall-mounted audio annunciator. This mechanism is easily manufactured and is usable by a relatively untrained individual without any tools being required to effect either installation or removal. The cover-attachment assembly 800 itself is useful with a wide variety of cover designs and form factors.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

Figure 19:
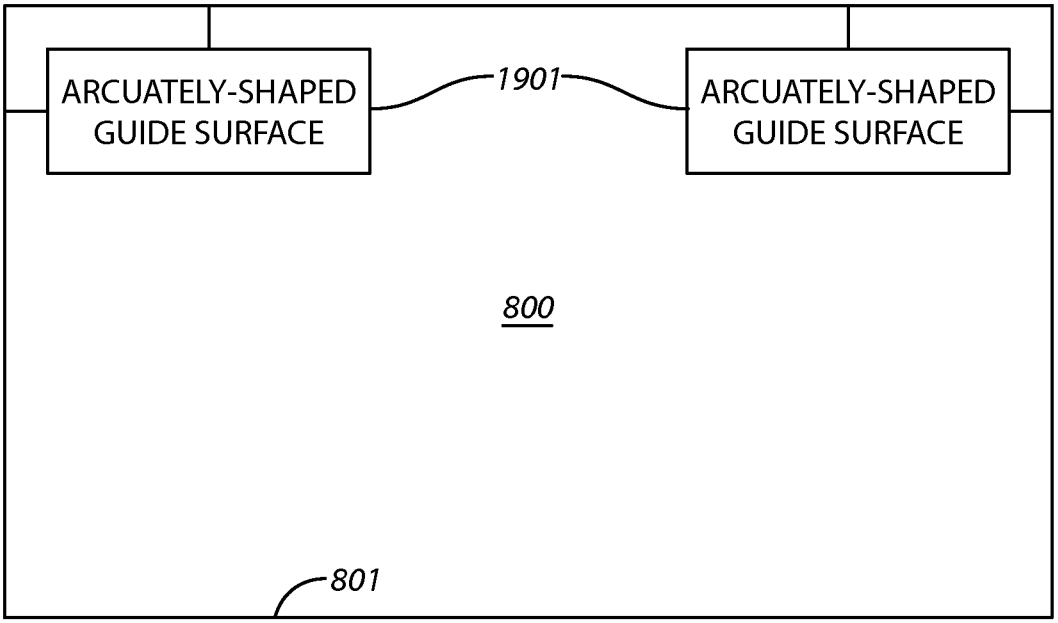
FIG. 19 comprises a front-elevational schematic view as configured in accordance with various embodiments of the invention.
Figure 20:
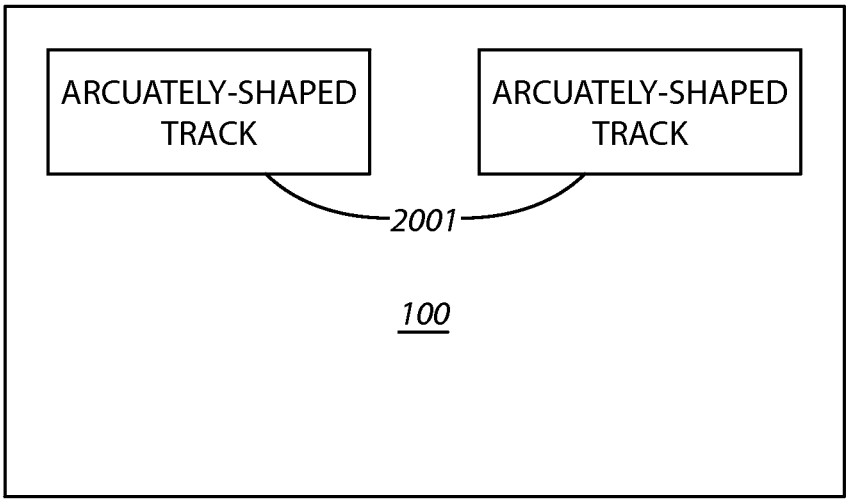
FIG. 20 comprises a front-elevational schematic view as configured in accordance with various embodiments of the invention.

As but one example in these regards, as described above the aforementioned track elements and their corresponding guide surfaces are located on the audio-annunciator housing 100 and the cover-attachment assembly 800. If desired, however, and referring now to FIGS. 19 and 20, one can readily essentially reverse this paradigm by equipping the cover-attachment assembly 800 with arcuately-shaped guide surfaces 1901 and the housing 100 with the corresponding arcuately-shaped tracks 2001. Similarly, the features of the described snap interfaces could be reversed as between the housing and the cover-attachment assembly.

Figure 21:
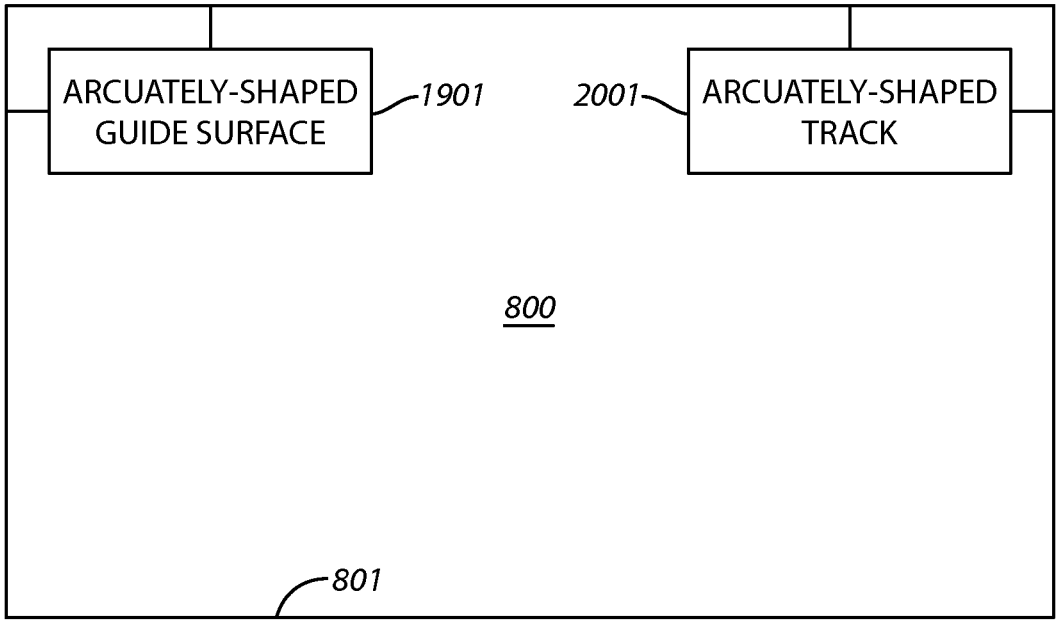
FIG. 21 comprises a front-elevational schematic view as configured in accordance with various embodiments of the invention.
Figure 22:
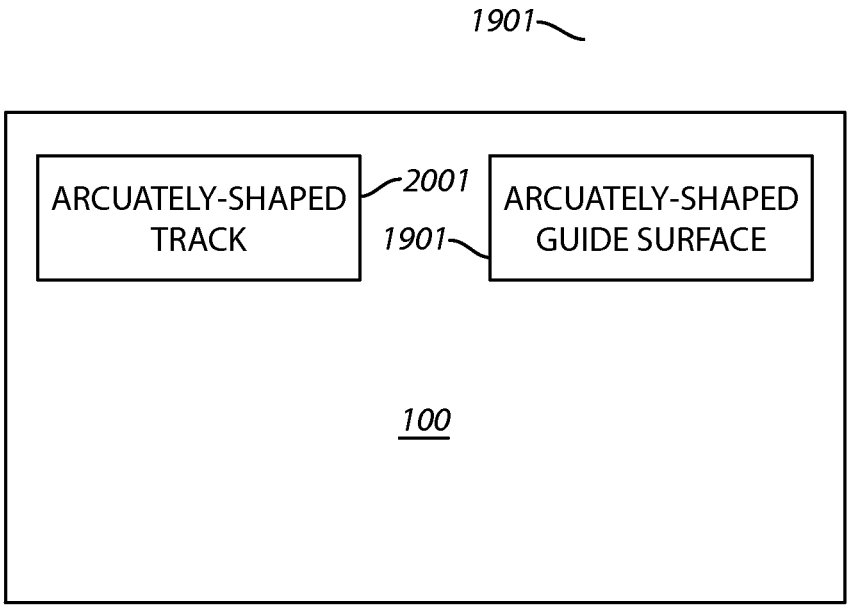
FIG. 22 comprises a front-elevational schematic view as configured in accordance with various embodiments of the invention.

In a similar vein, and referring now to FIGS. 21 and 22, these teachings will also readily accommodate equipping the cover-attachment assembly 800 with both an arcuately-shaped guide surface 1901 and an arcuately-shaped track 2001 while configuring the housing 100 to have a complimentary arcuately-shaped track 2001 and an arcuately-shaped guide surface 1901, respectively.

I claim:

1. An apparatus comprising:

an audio-annunciator housing configured to be mounted to a wall, wherein the audio-annunciator housing comprises:

at least one arcuately-shaped track having an arcuate track length, the arcuately-shaped track including a pair of arcuate track surfaces disposed on opposite sides of the track that extend along the arcuate track length; and a cover-attachment sensor;

at least one snap interface;

a cover-attachment assembly comprising:

at least one arcuately-shaped guide surface having an arcuate guide surface length, the arcuately-shaped guide surface shaped, sized, and positioned to fit within the arcuately-shaped track between the arcuate track surfaces thereof, the arcuately shaped guide surface length configured to fit into the arcuate track length when pivotally attaching the cover-attachment assembly to the audio-annunciator housing;

a cover-attachment sensor actuator that is configured to be sensed by the cover-attachment sensor when the arcuately shaped guide surface of the cover-attachment assembly is slidably pivoted betweeen the arcuate track surfaces of the auto-annunicator housing to indicate the cover attachment assembly is in the installed position; and at least one snap interface that is shaped, sized, and positioned to lockingly mate with the audio-annunciator housing snap interface to hold the cover-attachment assembly in an installed position with respect to the audio-annunciator housing.

2. The apparatus of claim 1 wherein the audio-annunciator housing comprises at least two of the arcuately-shaped tracks.

3. The apparatus of claim 1 wherein the at least one arcuately-shaped track is at least partially open on a side of the audio-annunciator housing.

4. The apparatus of claim 3 wherein the audio-annunciator housing comprises at least two of the arcuately-shaped tracks and wherein a first one of the arcuately-shaped tracks is open on a first side of the audio-annunciator housing and a second one of the arcuately-shaped tracks is open on a second side of the audio-annunciator housing that is opposite to the first side.

5. The apparatus of claim 1 wherein the at least one arcuately-shaped track has its entrance opening disposed at an edge where a top side of the audio-annunciator housing meets a front side of the audio-annunciator housing.

6. The apparatus of claim 1 wherein the at least one arcuately-shaped track is without any substantial non-arcuate discontinuity.

7. The apparatus of claim 1 wherein the audio-annunciator housing snap interface comprises an exterior feature of the audio-annunciator housing.

8. The apparatus of claim 1 wherein the audio-annunciator housing snap interface comprises an inflexible component and the cover-attachment assembly snap interface comprises a flexible, resilient component.

9. The apparatus of claim 1 wherein the audio-annunciator housing snap interface and the cover-attachment assembly snap interface are configured to readily facilitate hand moving the cover-attachment assembly from the installed position to a non-installed position with respect to the audio-annunciator housing.

10. The apparatus of claim 1 further comprising:

a cover that is integrally combined with the cover-attachment assembly.

11. The apparatus of claim 1 further comprising:

a cover that is non-integrally combined with the cover-attachment assembly.

12. The apparatus of claim 1 wherein the cover-attachment sensor comprises an electrical switch that is responsive to physically contacting the cover-attachment sensor actuator.

13. The apparatus of claim 1 wherein the cover-attachment sensor comprises an optically-based sensor.

14. The apparatus of claim 1 wherein the cover-attachment sensor comprises a capacitively-based sensor.

15. The apparatus of claim 1 wherein the cover-attachment sensor comprises a magnetically-based sensor.

16. An apparatus configured for use with an audio-annunciator housing that is configured to be mounted to a wall and wherein the audio-annunciator housing comprises at least one arcuately-shaped track defined by a pair of arcuately-shaped wall portions disposed on opposite sides of the arcuately-shaped track, a cover-attachment sensor, and at least one snap interface, the apparatus comprising:

a cover-attachment assembly comprising:

at least one arcuately-shaped guide member having a length and an arcuate guide surface along the length of the arcuately-shaped guide member, the length arcuately-shaped guide member being shaped, sized, and positioned to fit within the arcuately-shaped track between the pair of arcuately-shaped wall portions along a length of the arcuate track when pivotally attaching the cover-attachment assembly to the audio-annunciator housing;

a cover-attachment sensor actuator that is configured to be sensed by the cover-attachment sensor when the arcuately shaped guide surface of the cover-attachment assembly is slidably pivoted between the arcuate track surfaces of the auto-annunciator housing to indicate the cover attachment assembly is in the installed position; and at least one snap interface that is shaped, sized, and positioned to lockingly mate with the audio-annunciator housing snap interface to hold the cover-attachment assembly in an installed position with respect to the audio-annunciator housing.

17. The apparatus of claim 16 wherein the at least one arcuately-shaped guide surface is without any substantial non-arcuate discontinuity.

18. The apparatus of claim 16 wherein the cover-attachment assembly snap interface comprises a flexible, resilient component.

19. The apparatus of claim 16 further comprising:

a cover that is integrally combined with the cover-attachment assembly.

20. The apparatus of claim 16 further comprising:

a cover interface configured to non-permanently secure the cover-attachment assembly to a cover for the audio-annunciator housing.

21. The apparatus of claim 20 wherein the cover interface comprises a snap-fit interface.

22. An apparatus for use with a cover-attachment assembly that comprises:

at least two arcuately-shaped guide surfaces having arcuate guide surface lengths;

and at least one snap interface;

the apparatus comprising:

an audio-annunciator housing configured to be mounted to a wall, wherein the audio-annunciator housing comprises:

at least two arcuately-shaped tracks having an arcuate track length, the arcuately-shaped tracks including a pair of arcuate track surfaces disposed on opposite sides of an individual arcuately-shaped track that extend along the individual track length, the individual arcuately-shaped track being shaped, sized, and positioned to receive along its arcuate length, a corresponding arcuate length of the arcuately-shaped guide surface between the arcuate track surfaces of the individual arcuately-shaped track when pivotally attaching the cover-attachment assembly to the audio-annunciator housing;

at least one snap interface that is shaped, sized, and positioned to lockingly mate with the cover-attachment assembly snap interface to hold the cover-attachment assembly in an installed position with respect to the audio-annunciator housing;

and a cover-attachment sensor configured to sense a cover-attachment sensor actuator when the cover-attachment assembly when the corresponding arcuately shaped guide surface is slidably pivoted with the individual arcuately shaped track between the arcuate track surfaces to indicate the cover attachment assembly in the installed position and wherein a first one of the arcuately-shaped tracks is open on a first side of the audio-annunciator housing and a second one of the arcuately-shaped tracks is open on a second side of the audio-annunciator housing that is opposite to the first side.

23. The apparatus of claim 22 wherein the audio-annunciator housing comprises at least two of the arcuately-shaped tracks.

24. The apparatus of claim 22 wherein the at least one arcuately-shaped track is at least partially open on a side of the audio-annunciator housing.

25. The apparatus of claim 22 wherein the at least one arcuately-shaped track has its entrance opening disposed at an edge where a top side of the audio-annunciator housing meets a front side of the audio-annunciator housing.

26. The apparatus of claim 22 wherein the at least one arcuately-shaped track is without any substantial non-arcuate discontinuity.

27. The apparatus of claim 22 wherein the audio-annunciator housing snap interface comprises an exterior feature of the audio-annunciator housing.

28. The apparatus of claim 22 wherein the audio-annunciator housing snap interface comprises an inflexible component.

29. An apparatus comprising:

an audio-annunciator housing configured to be mounted to a wall, wherein the audio-annunciator housing comprises at least one snap interface;

a cover-attachment assembly comprising at least one snap interface that is shaped, sized, and positioned to lockingly mate with the audio-annunciator housing snap interface to hold the cover-attachment assembly in an installed position with respect to the audio-annunciator housing, the audio-annunciator housing and the cover-attachment assembly comprising at least one arcuately-shaped guide surface having an arcuate guide surface length that is shaped, sized, and positioned to move concentrically between a pair of arcuately-shaped track surfaces of an arcuately-shaped track and along an arcuate track length of the arcuately-shaped track when pivotally attaching the cover-attachment assembly to the audio-annunciator housing; and a cover-attachment sensor and a cover-attachment sensor actuator, the cover sensor configured to sense the cover-attachment sensor actuator when the arcuately shaped guide surface is slidably pivoted with between the arcuate track surfaces to indicate the cover attachment assembly and the cover-attachment assembly is in the installed position.

30. The apparatus of claim 29 wherein the audio-annunciator housing comprises at least two arcuately-shaped tracks and wherein a first one of the arcuately-shaped tracks is open on a first side of the audio-annunciator housing and a second one of the arcuately-shaped tracks is open on a second side of the audio-annunciator housing that is opposite to the first side.

* * * * *

UNITED STATES PATENT AND TRADEMARK OFFICE

CERTIFICATE OF CORRECTION

PATENT NO. : 8,565,469 B2
APPLICATION NO. : 12/620210
DATED : October 22, 2013
INVENTOR(S) : Birdwell It is certified that error appears in the above-identified patent and that said Letters Patent is hereby corrected as shown below:

ON THE TITLE PAGE AND IN THE SPECIFICATION

Item (54) and Column 1, Line 3: Change "Audio-Annunciating" to -- Audio Annunciator --;

IN THE CLAIMS

Claim 1, Column 8, Line 54: Change "betweeen" to -- between --; and

Claim 1, Column 8, Line 55: Change "auto-annunciator" to -- audio-annunciator --.

Signed and Sealed this
Twenty-seventh Day of May, 2014

Michelle K. Lee

Michelle K. Lee
*Deputy Director of the United States Patent and Trademark Office*